US006527423B2

(12) United States Patent
Shoji

(10) Patent No.: US 6,527,423 B2
(45) Date of Patent: Mar. 4, 2003

(54) HEADLIGHT

(75) Inventor: Masao Shoji, Osaka (JP)

(73) Assignee: Cateye Co., Ltd., Osaka (JP)

( * ) Notice: Subject to any disclaimer, the term of this patent is extended or adjusted under 35 U.S.C. 154(b) by 0 days.

(21) Appl. No.: 09/909,697

(22) Filed: Jul. 20, 2001

(65) Prior Publication Data

US 2002/0018347 A1 Feb. 14, 2002

(30) Foreign Application Priority Data

Aug. 7, 2000 (JP) ..... 2000-238210

(51) Int. Cl.[7] ..... F21V 1/00

(52) U.S. Cl. ..... 362/509; 362/514; 362/538; 362/522; 362/329; 362/338

(58) Field of Search ..... 362/509, 514, 362/525, 538, 522, 326, 328, 329, 332, 336, 337, 338

(56) References Cited

U.S. PATENT DOCUMENTS

| | | | | |
|---|---|---|---|---|
| 1,955,599 A | | 4/1934 | Lamblin-Parent | 240/41.3 |
| 4,177,505 A | * | 12/1979 | Carel | 362/328 |
| 5,440,456 A | * | 8/1995 | Bertling et al. | 362/309 |

FOREIGN PATENT DOCUMENTS

| | | | |
|---|---|---|---|
| EP | 0 354 961 | 2/1990 | 27/30 |
| GB | 611032 | 10/1948 | |
| GB | 820500 | 9/1959 | |
| JP | 2-31003 | 2/1990 | |
| JP | 8-268154 | 10/1990 | |
| JP | 4-24203 | 2/1992 | |
| JP | 10-40709 | 2/1998 | |
| JP | 11-329005 | 11/1999 | |
| JP | 2000-48608 | 2/2000 | |
| JP | 2000-173322 | 6/2000 | |

OTHER PUBLICATIONS

Patent Abstract of Japan, Publication No. 2000048608, Date of Publication Feb. 18, 2000, "Lense for Vehicle Lamp", Application No. 10230169, date of filing Jul. 30, 1998, Applicant Nippon Zeon Co Ltd, Inventor(s): Mauyama Junko and Obara Teiji.

Patent Abstract of Japan, Publication No. 2000173322A, Date of Publication Jun. 23, 2000, "Projection Type Headlight For Vehicle", Application No. 11347457, date of filing Dec. 7, 1999, Applicant Robert Bosch GmbH, Inventor(s): Meier Andreas, Horst, Oschmann, Langhammer Gert, and Glaser Siegmar.

Patent Abstract of Japan, Publication No. 11329005, Date of Publication Nov. 30, 1999, "Lamp", Application No. 10130197, date of filing May 13, 1998, Applicant Stanley Electric Co., Ltd. Inventor(s): Koike Teruo, Futami Takashi, and Kawaguchi Yoshifumi.

Patent Abstract of Japan, Publication No. 10040709, Date of Publication Feb. 13, 1998, "Head Lamp for Vehicle", Application No. 08214242, date of filing Jul. 25, 1996, Applicant Koito Mfg. Co. Ltd., Inventor(s): Serizawa Hiroyuki.

Partial English Translation of Japanese Utility Model Laying–Open No. 4–24203, Date of Laying–Open: Feb. 27, 1992, "Headlight for a Car", Utility Model Appln. No. 2–64733, Filing Date: Jun. 19, 1990, Applicant: Stanley Electric Co., Ltd., Inventor: Shusako Sato.

(List continued on next page.)

*Primary Examiner*—Sandra O'Shea
*Assistant Examiner*—Bertrand Zeade
(74) *Attorney, Agent, or Firm*—Olson & Hierl, Ltd.

(57) ABSTRACT

A headlight allowing easy adjustment of a delicate light distribution pattern during manufacturing is provided. The headlight includes a light source, a reflector surrounding the light source from its backside to reflect light incident from the light source frontward, and a front lens located in front of the light source and the reflector. The front lens is provided with at least two portions different in light transmission characteristic from each other.

10 Claims, 6 Drawing Sheets

OTHER PUBLICATIONS

Partial ENglish Translation of Japanese Utility Model Laying–Open No. 2–31003, Date of Laying–Open: Feb. 27, 1990, "Light for a Vehicle", Utility Model Appln. No. 63–108230, Filing Date: Aug. 19, 1988, Applicant: Ichikoh Ind., Ltd., Inventor: Toshinori Suzuki.

Patent Abstract of Japan, Publicataion No. 08268154, Date of Publication Oct. 15, 1996, "Lighting Fixture for Vehicle", Application No. 07069448, Date of Filing Mar. 28, 1995, Applicant Toyota Motor Corp., Inventor(s) Okabe Shin and Hidaka Tatsuro.

* cited by examiner

HEADLIGHT

BACKGROUND OF THE INVENTION

1. Field of the Invention

The present invention relates to headlights, and more particularly to a headlight allowing simple adjustment of a delicate luminous intensity (or light) distribution pattern in manufacturing.

2. Description of the Background Art

Conventional headlights have been configured as follows.

(a) Light emitted from a filament placed near the focal point of a parabolic mirror is reflected by the paraboloid to form a collimated beam. A front lens adjusts the collimated beam to attain a desired light distribution pattern.

(b) Light emitted from a filament is received at a multi-surface mirror, which reflects the light frontward in a desired light distribution pattern. A front lens simply serves as a cover. Each portion of the multi-surface mirror has a size and angular arrangement determined to reflect the light incident from the filament in a predetermined direction such that the desired light distribution pattern is attained in their entirety.

The headlight is used for night traffic, so that attention should be paid not only to safety of a person utilizing the headlight but also to safety of a person driving a car coming from the opposite direction. This emphasizes a need to meticulously adjust a light distribution pattern of the headlight. The structure of a conventional headlight, however, does not allow such adjustment down to detail. Thus, to enable the meticulous adjustment of the light distribution pattern, manual work has been done, e.g., to apply a light shield to a portion of the front lens. Such manual work, however, would degrade efficiency in manufacturing, and a light distribution pattern exactly as desired would be hard to realize. Accordingly, there has been a demand for development of a headlight having a structure with which meticulous adjustment of a light distribution pattern can readily be performed in mass production.

SUMMARY OF THE INVENTION

An object of the present invention is to provide a headlight that allows easy setting of a light distribution pattern down to detail when manufacturing.

According to the present invention, a headlight projecting light frontward includes: a light source; a reflector surrounding the light source from its backside to reflect light incident from the light source frontward; and a front lens located in front of the light source and the reflector. The front lens includes at least two portions different in light transmission characteristic from each other.

Provision of the front lens having the portions different in light transmission characteristic makes it possible to determine, for each portion, a travelling direction of the luminous flux having been transmitted therethrough, and its spreading manner—diverged, parallel or converged—and the degree of such divergence or convergence. Thus, it becomes possible to design in advance the light distribution pattern down to detail, e.g. by increasing the number of the portions having different light transmission characteristics, changing their positions or shapes, or increasing the aforementioned degree of divergence or the like. To manufacture the headlight, a mold for injection molding, for example, can be prepared to conform to the design. Accordingly, it is possible to manufacture a headlight ensuring a desired light distribution pattern with an automated injection molding process, not relying on the manual work as in the conventional case.

Preferably, the front lens of the headlight of the present invention has a center lens in the center, and the center lens includes at least two portions having different light transmission characteristics.

Luminous flux emitted from the light source directly reaches the center lens and is transmitted therethrough. As the center lens is divided into the portions different in light transmission characteristic, the travelling direction and the spreading manner—diverged, parallel or converged—of the luminous flux having been transmitted through each portion can be determined independently from each other. This allows superimposition of the luminous flux transmitted through a portion of the front lens other than the center lens on the luminous flux transmitted through the center lens. As a result, it is possible to readily achieve a light distribution pattern controlled with extremely high precision.

Preferably, the at least two portions of the center lens include a portion from which the light incident from the light source is radiated with an increased degree of divergence, and a portion from which the light is radiated restricting the degree of divergence.

Provision of such portions facilitates designing of a desired light distribution pattern. For example, a light distribution pattern for illuminating far ahead, that for illuminating beneath a user's foot in particular, and other patterns can be attained.

Preferably, the aforementioned portion from which the light is radiated restricting the degree of divergence radiates a parallel beam.

The parallel beam can be formed, e.g. by disposing a convex lens at the relevant portion and positioning the light source at the focal point of the convex lens. The parallel beam thus radiated from the center of the front lens is allowed to be superimposed on the light beam transmitted through the remaining portion. As a result, it is possible to obtain various kinds of light distribution patterns that can illuminate far ahead.

Preferably, the center lens is composed of a concentric lens and a bar lens.

With such an arrangement, of the luminous flux from the light source reaching the center lens, that incident on the concentric lens and that incident on the bar lens can be controlled independently from each other. Specifically, it is possible to select and set the travelling direction, the spreading manner—diverged, parallel or converged—and the degree of such divergence or convergence for each of the luminous flux transmitted through the respective lenses. As a result, the luminous flux transmitted through the center lens can be superimposed on the luminous flux not transmitted through the center lens, so that it is possible to readily achieve an extremely delicate light distribution pattern.

Of the luminous flux passing through the center lens, that having been transmitted through the concentric lens becomes a parallel beam, while that having been transmitted through the bar lens becomes a divergent beam that diverges outward. For example, by arranging the parallel beam at the upper level and the divergent beam at the lower level, it becomes possible to illuminate a wide range from beneath the user's foot to far ahead in the travelling direction while preventing a driver of the oncoming car from suffering dazzle. Thus, with the structure described above, a headlight allowing easy designing of a light distribution pattern down to detail is obtained. It is noted that the parallel beam is obtained from the light transmitted through the concentric lens by positioning the light source at the focal point of the concentric lens.

Preferably, the aforementioned concentric lens is a Fresnel lens.

Using the Fresnel lens, it is possible to reduce the thickness of the front lens in the relevant portion. The manufacturing process is also simplified as integral injection molding is allowed.

Preferably, the headlight of the present invention further includes a cylindrical condenser lens surrounding the light source from its periphery to transmit the light incident from the light source, and a reflector surrounding the light source and the cylindrical condenser lens from their backsides to reflect the light transmitted through the cylindrical condenser lens frontward.

The cylindrical condenser lens transmits the light emitted from the light source sideward, restricting its degree of divergence. The light transmitted through the cylindrical condenser lens generally forms a parallel beam. If such a cylindrical condenser lens is not provided, in order to reflect luminous flux of the same quantity, a reflector would be required which has a size covering an area up to a crossing point with a "downsizing reference line" that is an extended line of the line connecting the light source and a position where the front end of the cylindrical convex lens is supposed to be located. With provision of the cylindrical condenser lens, the light received from the light source can be condensed, so that a reflector only needs to cover an area up to the front end of the cylindrical condenser lens. This reduction in size of the reflector allows positioning of the front lens and the light source closer to each other. Therefore, using a center lens of the same diameter, the solid angle at the light source encompassing the center lens is increased. The luminous flux passing through the center lens is thus increased, so that the influence of the center lens on the light distribution pattern is increased correspondingly. The explanation about the solid angle not only applies to the center lens, but also applies to the entire front lens. Accordingly, by the downsizing described above, the at least two portions with different light transmission characteristics provided at the front lens come to have a great influence on the light distribution pattern.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
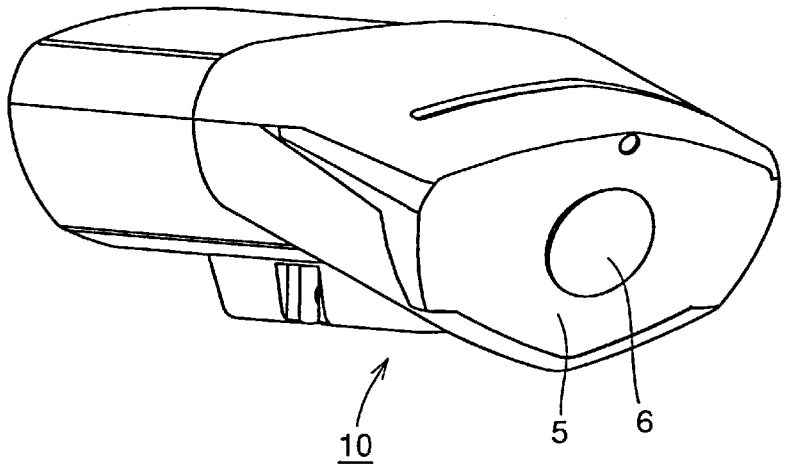
FIG. 1 is a perspective view showing an appearance of the headlight according to an embodiment of the present invention.

Embodiments of the present invention will be described with reference to the drawings. FIG. 1 is a perspective view of the headlight according to an embodiment of the present invention. This headlight 10 is attached to a bicycle and projects light frontward from a front lens 5 including a center lens 6.

Figure 2:
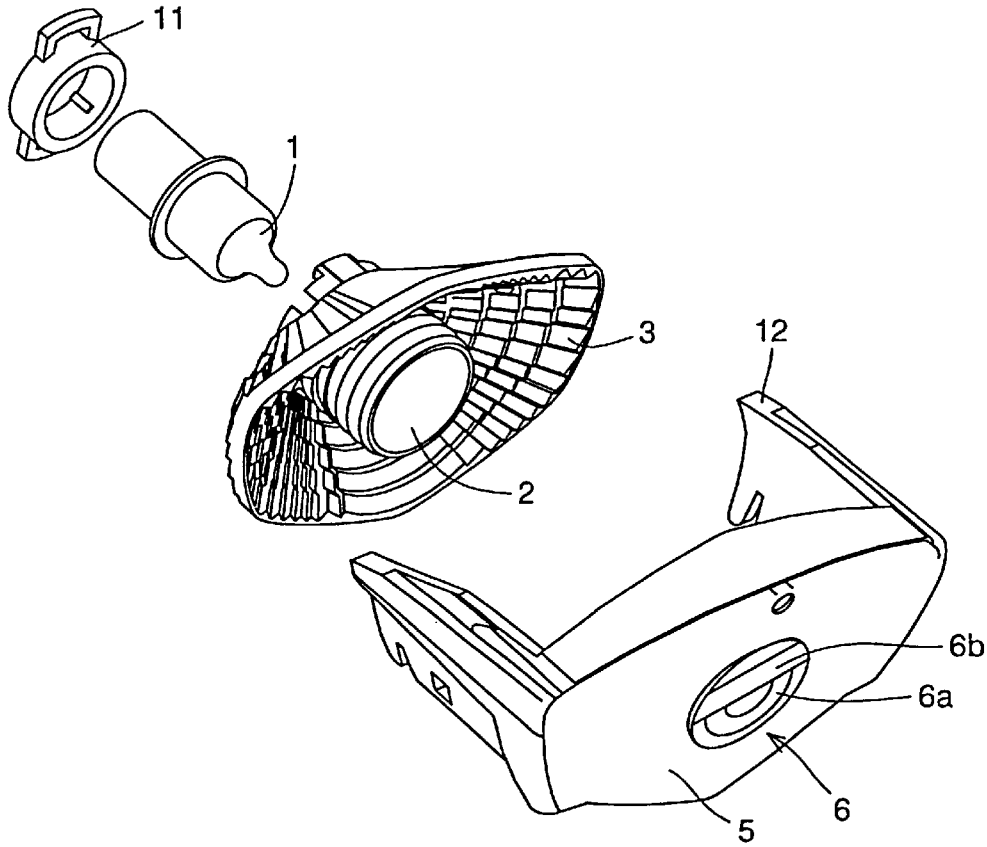
FIG. 2 is an exploded view of portions of the headlight in FIG. 1.

FIG. 2 is an exploded view of portions of the headlight shown in FIG. 1. Front lens 5 including center lens 6 and a connect portion 12 by which the front lens is attached to a housing (not shown) are formed in one piece. Center lens 6 is composed of a bar lens 6*b* and a concentric lens 6*a*.

At the back of the front lens, a multi-surface mirror 3 and a cylindrical convex lens 2 surrounded by the multi-surface mirror are provided. A Fresnel lens is employed as the cylindrical convex lens to achieve a sufficient effect of the convex lens with a thin lens. A light source 1 with a filament (not shown) is inserted into Fresnel lens 2. The light source is supplied with power via a socket 11.

Figure 3:
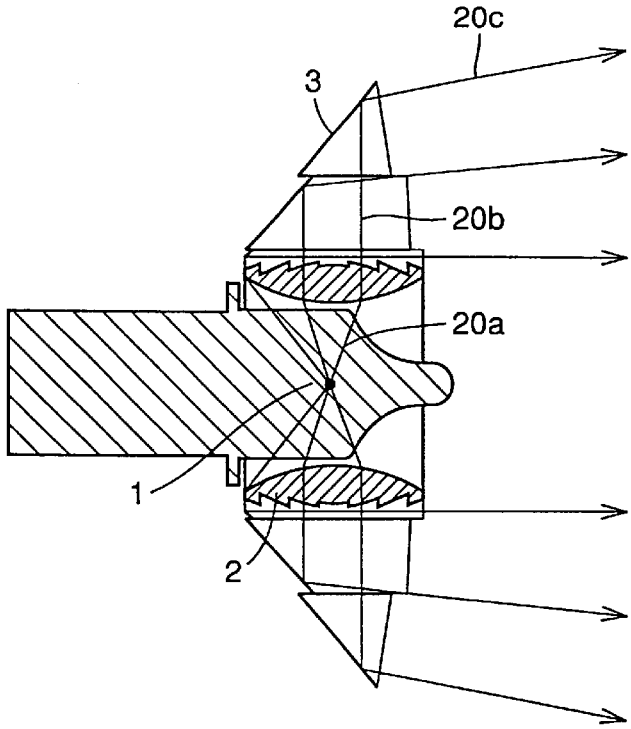
FIG. 3 illustrates light paths of the light emitted from the light source of the headlight according to the embodiment of the present invention.

FIG. 3 is a cross sectional view showing light paths of the light emitted from the light source when the headlight is in operation. The filament has been designed to emit light from a narrow range on a line intersecting the central axis of the cylinder at right angles. This short filament is disposed approximately at the focal point of Fresnel lens 2. As light 20*a* is radiated from the filament located at the focal point of the cylindrical convex lens, it becomes a parallel beam 20*b* after being transmitted through the convex lens. The parallel beam is reflected by multi-surface mirror 3 that is arranged to direct the light frontward with a predetermined angle, and projected frontward as a reflected light 20*c*. In FIG. 3, the light is projected frontward to slightly diverge. Using such a cylindrical convex lens, it is possible to promote downsizing of the headlight while ensuring the high efficiency, without a reflector covering a wide area.

Figure 4:
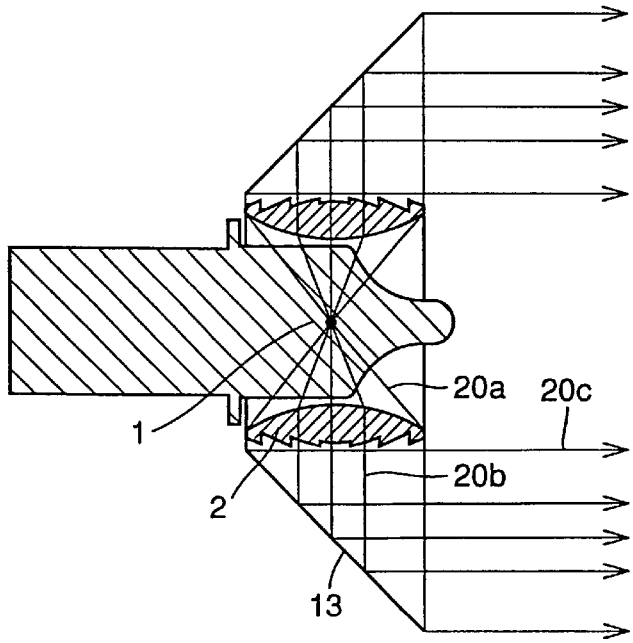
FIG. 4 illustrates light paths of the light emitted from the light source of the headlight according to another embodiment of the present invention wherein a conular reflector is employed.

FIG. 4 shows light paths from the light source in the case where a common cone reflector 13 is used instead of the multi-surface mirror. The light 20*a* radiated from light source 1 sideward is transmitted through cylindrical Fresnel lens 2 and becomes parallel beam 20*b*, which is reflected by cone reflector 13 and projected frontward as parallel beam 20*c*.

Figure 5:
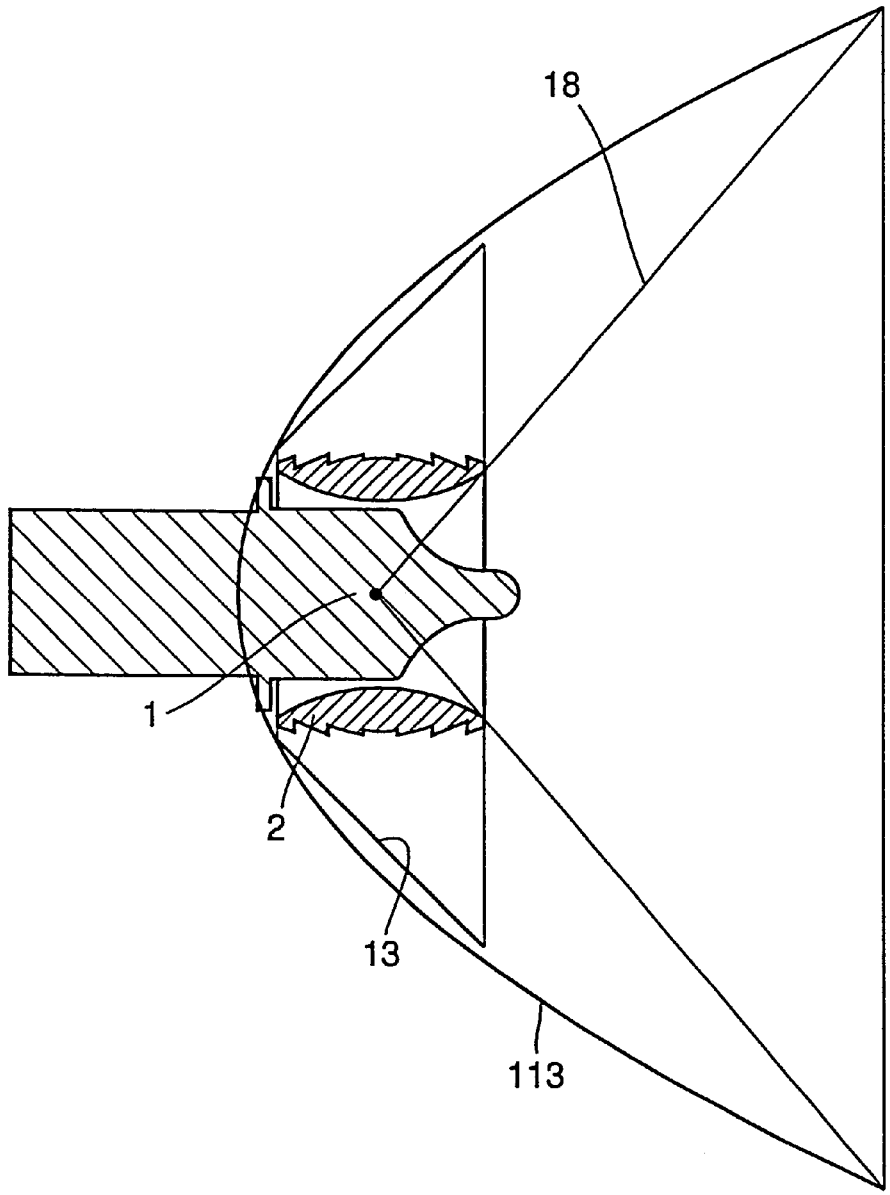
FIG. 5 is a diagram for comparison between the cone reflector of the headlight in FIG. 4 and a reflector of a conventional headlight.

In FIG. 5, reflector 13 of the headlight according to the present invention provided with the cylindrical convex lens is compared in size with a reflector 113 of a conventional headlight unprovided with the cylindrical convex lens. Here, the two headlights are designed to use the respective reflectors to reflect and project frontward the same quantities of luminous flux. In the case of the conventional headlight without the cylindrical convex lens, reflector 113 is required to have a size that covers an area up to a crossing point with downsizing reference line 18 described above, which is an extended line of the line connecting light source 1 and a position where the front end of the cylindrical convex lens is supposed to be located. In the case of the headlight of the present invention, the cylindrical convex lens is used to project the parallel beam restricted in the degree of divergence, so that reflector 13 only needs to cover an area up to the front end of the convex lens. If the restricted degree of divergence is increased, a smaller reflector could be used according to the degree of restriction. With a reflector too small in size, however, it would become necessary to increase the dimensional accuracy of the reflector. Accordingly, the parallel beam is desired as the light restricted in divergence. The parallel beam facilitates designing of the surface of the reflector for forming an intended light distribution pattern.

With the present invention, a reflector having a depth of approximately one third and a width of approximately four sevenths of the conventional reflector can be used to secure the same efficiency. This results in a remarkable downsizing since the volume of the rectangular parallelepiped for containing the reflector is reduced to approximately 10% of the conventional case.

Figure 6:
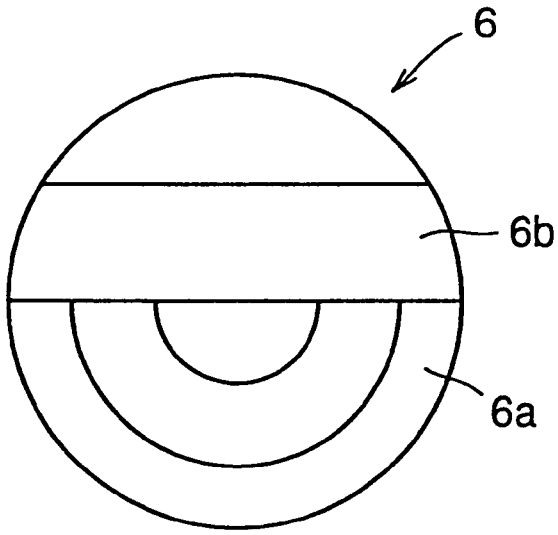
FIG. 6 is a front view of the center lens of the headlight in FIG. 1.
Figure 7:
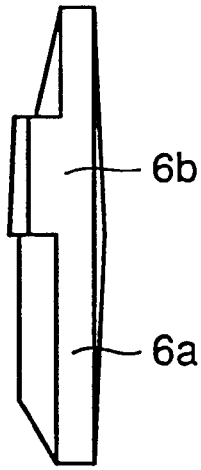
FIG. 7 is a vertical sectional view of the center lens shown in FIG. 6.
Figure 8:
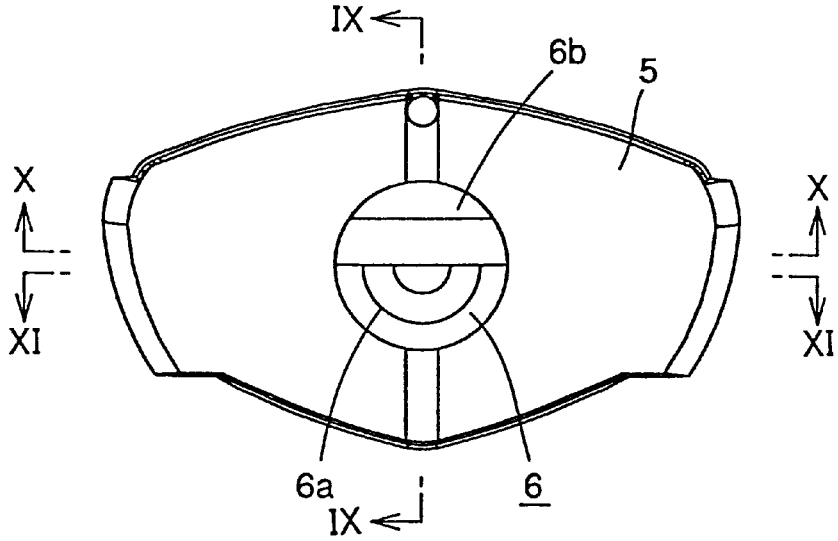
FIG. 8 is a front view of the front lens of the headlight in FIG. 1.

Center lens 6 provided to the front lens is now explained. FIG. 6 is a front view and FIG. 7 is a vertical sectional view of the center lens. Center lens 6 is composed of an upper bar-shaped convex lens 6*b* and a lower concentric Fresnel lens 6*a*. FIG. 8 is a front view of front lens 5 provided with center lens 6.

Figure 9:
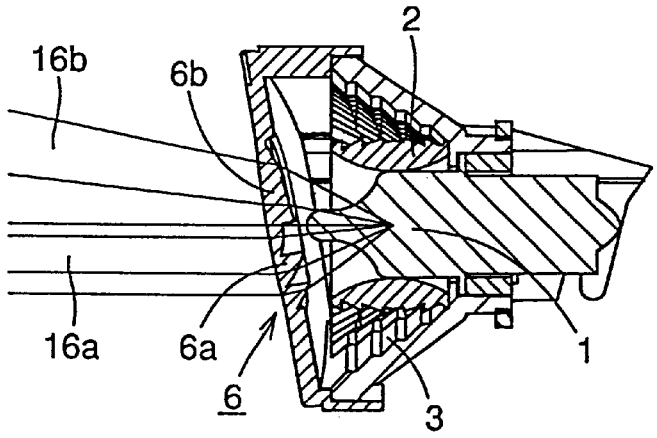
FIG. 9 shows a cross section taken along the line IX—IX in FIG. 8.

FIG. 9 shows a cross section taken along the line IX—IX in FIG. 8. Referring to FIG. 9, light source 1 is placed at the focal point of concentric Fresnel lens 6*a*. As seen from FIG. 9, the light 16*b* transmitted through the upper bar lens of center lens 6 is projected frontward, diverged in an upper direction. The light 16*a* transmitted through the lower portion of center lens 6 is projected frontward as the parallel beam.

Figure 10:
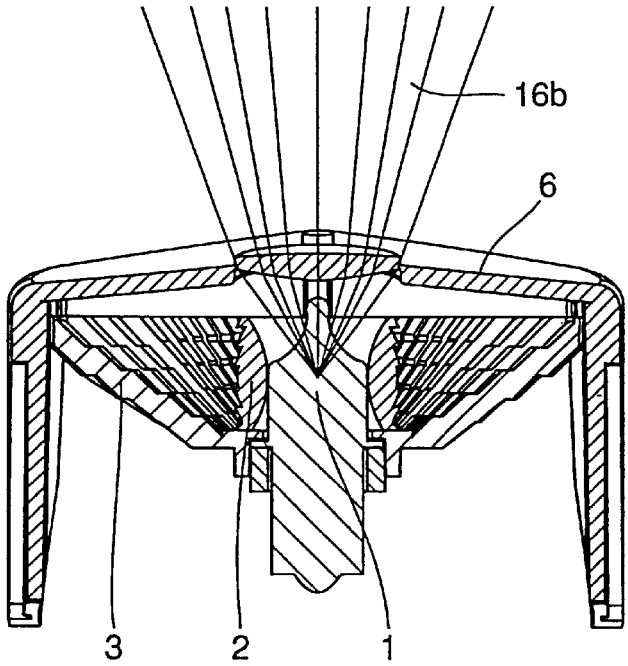
FIG. 10 shows a cross section taken along the line X—X in FIG. 8.
Figure 11:
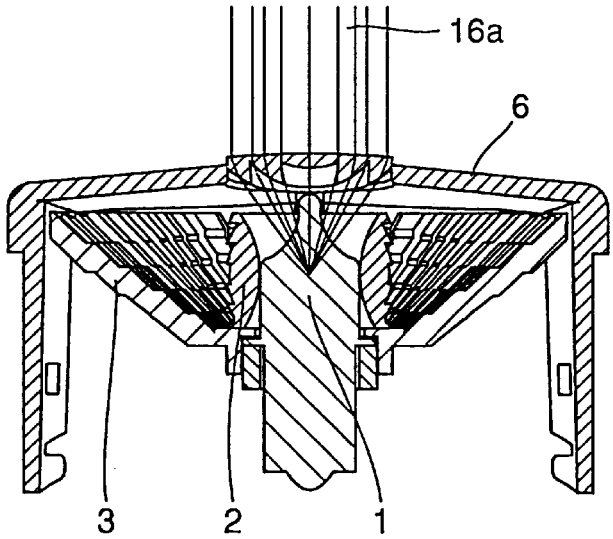
FIG. 11 shows a cross section taken along the line XI—XI in FIG. 8.

FIGS. 10 and 11 show cross sections taken along the lines X—X and XI—XI in FIG. 8, respectively. It is appreciated that light 16*b* transmitted through bar lens 6*b* is again projected frontward with divergence. It is also understood that light 16*a* transmitted through concentric lens 6*a* is again projected frontward as the parallel beam without divergence.

Provision of the center lens having such portions different in light transmission characteristic increases the degree of freedom of feasible light distribution. For example, when riding on the bicycle, it is possible to illuminate frontward only in a narrow range into the distance to alleviate the dazzle suffered by a driver of an oncoming car on the opposite lane.

In the front lens described above, the concentric lens and the bar lens may be replaced with each other in vertical relationship according to where on the bicycle the headlight is being attached or according to a light distribution pattern that is being desired.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A headlight projecting light frontward, comprising:

a light source;

a reflector surrounding said light source from its backside to reflect light incident from said light source forward; and a front lens located in front of said light source and said reflector;

said front lens including a center lens at its center, said center lens having at least two portions having light transmission characteristics different from each other, one portion being a concentric lens and another portion being a bar lens.

2. The headlight according to claim 1, wherein the at least two portions of said center lens include a portion through which light incident from said light source is radiated with an increased degree of divergence, and a portion through which the light incident from said source is radiated restricting the degree of divergence.

3. The headlight according to claim 2, wherein said portion through which the light incident from said light source is radiated restricting the degree of divergence radiates a parallel beam.

4. The headlight according to claim 1, wherein said concentric lens is a Fresnel lens.

5. A headlight projecting light forward, comprising:

a light source;

a reflector surrounding said light source from its backside to reflect light incident from said light source forward;

a front lens located in front of said light source and said reflector;

said front lens including at least two portions having light transmission characteristics different from each other; and further comprising a cylindrical condenser lens surrounding said light source from its periphery to transmit the light incident from said light source, and a reflector surrounding said light source and said cylindrical condenser lens from their backsides to reflect the light transmitted through said cylindrical condenser lens frontward.

6. A headlight for projecting light frontward, comprising:

light source means for emitting light;

reflector means surrounding said light source means from its backside for reflecting light incident from said light source means forward; and front lens means located in front of said light source means and said reflector means for transmitting light;

said front lens means including a center lens at its center, said center lens having at least two portions having light transmission characteristics different from one another, one of the two portions being a concentric lens and the other of the two portions being a bar lens.

7. The headlight according to claim 6, wherein the at least two portions of said center lens include a portion through which light incident from said light source means is radiated with an increased degree of divergence, and a portion through which the light incident from said light source means is radiated restricting the degree of divergence.

8. The headlight according to claim 7, wherein said portion through which the light incident from said light source means is radiated restricting the degree of divergence radiates a parallel beam.

9. The headlight according to claim 6, wherein said concentric lens is a Fresnel lens.

10. The headlight according to claim 6, further comprising a cylindrical condenser lens surrounding said light source means from its periphery to transmit the light incident from said light source means, and a reflector surrounding said light source means and said cylindrical lens from their backsides to reflect the light transmitted through said cylindrical condenser lens forward.

* * * * *